US006736557B2

(12) United States Patent
DeVore et al.

(10) Patent No.: US 6,736,557 B2
(45) Date of Patent: May 18, 2004

(54) PRINTHEAD GAP ADJUSTMENT MECHANISM FOR AN IMAGING APPARATUS

(75) Inventors: David Wayne DeVore, Richmond, KY (US); Steven Andrew Rice, Shelbyville, KY (US); Michael Ray Wedding, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 23 days.

(21) Appl. No.: 10/235,406

(22) Filed: Sep. 5, 2002

(65) Prior Publication Data

US 2004/0047665 A1 Mar. 11, 2004

(51) Int. Cl.[7] ..... B41J 11/20

(52) U.S. Cl. ..... 400/59; 400/56; 400/354; 400/355

(58) Field of Search ..... 400/55, 56, 57, 400/58, 59, 354, 353

(56) References Cited

U.S. PATENT DOCUMENTS 3,915,281 A * 10/1975 Blomquist et al. ..... 400/569
4,063,630 A * 12/1977 Crowe et al. ..... 400/144.2
4,178,106 A 12/1979 Mailer et al.
4,222,673 A 9/1980 Plaza et al.
4,243,331 A 1/1981 Savage et al.
4,268,177 A * 5/1981 Veale ..... 400/55
4,426,165 A 1/1984 Irro
4,609,294 A 9/1986 Gomoll et al.
4,657,415 A 4/1987 Kikuchi et al.
4,775,869 A * 10/1988 Minowa ..... 347/197
5,000,590 A * 3/1991 Einem ..... 400/55
5,040,908 A * 8/1991 Matsuya et al. ..... 400/62
5,051,008 A 9/1991 Honda et al.
5,078,517 A * 1/1992 Hiroshi et al. ..... 400/59
5,135,316 A 8/1992 Kuramitsu et al.
5,156,466 A * 10/1992 Inagaki et al. ..... 400/56
5,172,137 A 12/1992 Hongo et al.
5,193,918 A 3/1993 Lohrmann et al.
5,257,867 A 11/1993 Ito et al.
5,547,292 A 8/1996 Harada
5,678,936 A 10/1997 Hino
5,751,301 A * 5/1998 Saikawa et al. ..... 347/8
5,964,541 A 10/1999 Murison et al.
6,059,468 A * 5/2000 Haug ..... 400/56
6,171,001 B1 1/2001 Nonaka
6,315,468 B2 11/2001 Kishida et al.
6,629,787 B2 * 10/2003 Lee et al. ..... 400/59

* cited by examiner

*Primary Examiner*—Stephen R. Funk
*Assistant Examiner*—Dave A. Ghatt
(74) *Attorney, Agent, or Firm*—Taylor & Aust, P.C.

(57) ABSTRACT

A printhead gap adjustment mechanism for use in an imaging apparatus includes a worm gear coupled to a carrier shaft to transmit a rotational motion to the carrier shaft. A worm screw is positioned in rotational cooperation with the worm gear, the worm screw having an axis of rotation. A first cam is coupled to the carrier shaft. A first cam follower surface is disposed in proximity to the first cam. A guide device guides the carrier shaft in a translational direction substantially parallel to the axis of rotation of the worm screw. A rotation of the worm screw transmits rotational motion to drive the first cam via the worm gear and the carrier shaft, the first cam engaging the first cam follower surface to effect a translational motion of the worm gear in the translational direction, thereby effecting a movement of the printhead in the translational direction.

35 Claims, 6 Drawing Sheets

CAM POSITION

PRINTHEAD GAP ADJUSTMENT MECHANISM FOR AN IMAGING APPARATUS

BACKGROUND OF THE INVENTION

1. Field of the Invention

The present invention relates to an imaging apparatus, and, more particularly, to a printhead gap adjustment mechanism for an imaging apparatus.

2. Description of the Related Art

A typical imaging apparatus, such as an ink jet printer or a thermal printer, forms an image onto a recording medium, such as paper or film, by causing ink or the like to be deposited onto the recording medium. For example, an ink jet printer forms an image on a recording medium by positioning a printhead in close proximity with the recording medium, and selectively ejecting ink from a plurality of ink jetting nozzles of the printhead to form a pattern of ink dots on the recording medium.

During ink jet printing, the printhead is spaced apart from the recording medium in a plane perpendicular to the recording medium. As the printhead is moved across the recording medium, from one end to another in a scan direction, ink is selectively ejected from the ink jetting nozzles to form a print swath. After completing at least one print swath, the recording medium is indexed a selected amount in a sub scan, i.e., paper feed, direction.

During the printing operations, the printhead must maintain a certain spacing, or gap, relative to the recording medium. Various factors affect the size of the gap, including tolerance stack up of manufactured parts, intentional or unintentional variation in recording medium thickness or weight, ambient thermal and humidity conditions, and settling or shifting of printer components due to shipping and setup at the user premises.

Analyses have shown a correlation between print quality and the printhead gap, i.e., the distance from the ink jet printhead to the recording medium. It is known in the art to provide printhead gap adjustment. For example, one conventional design employs a two-stage carrier lift mechanism, wherein the printhead location may be changed by moving a positioning lever. Such designs typically rotate the carrier shaft on an internal eccentric. Another design employs the use of a link and cam system to lift the printhead carrier. Although both of these designs provide repositioning of the printhead in a printhead gap direction, they typically provide two distinct positions, and they also yield printhead movement in directions other than the printhead gap adjustment direction.

What is needed in the art is an improved printhead gap adjustment mechanism for use with an imaging apparatus.

SUMMARY OF THE INVENTION

The present invention provides an improved printhead gap adjustment mechanism for use with an imaging apparatus.

In one form thereof, the present invention relates to a printhead gap adjustment mechanism for use in an imaging apparatus. The imaging apparatus includes a printhead carrier that carriers a printhead, a frame, and a carrier shaft. The carrier shaft is rotably and slidably coupled with the printhead carrier and the frame. The printhead gap adjustment mechanism includes a worm gear coupled to the carrier shaft to transmit a rotational motion to the carrier shaft. A worm screw is positioned in rotational cooperation with the worm gear, the worm screw having an axis of rotation. A first cam is coupled to the carrier shaft. A first cam follower surface is disposed in proximity to the first cam. A guide device guides the carrier shaft in a translational direction substantially parallel to the axis of rotation of the worm screw. A rotation of the worm screw transmits rotational motion to drive the first cam via the worm gear and the carrier shaft. The first cam engages the first cam follower surface to effect a translational motion of the worm gear in the translational direction, thereby effecting a movement of the printhead in the translational direction.

An advantage of the present invention is the ability to adjust the printhead position in the direction of opening or closing the printhead gap, i.e., a printhead gap adjustment direction, without the adjustment having any effect on the printhead location other than perpendicular to the recording medium.

Another advantage is to provide the capability of infinite adjustment of the printhead gap within a given pre-selected range.

Yet another advantage is to provide the capability to make printhead gap adjustments using a low-cost unidirectional motor.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
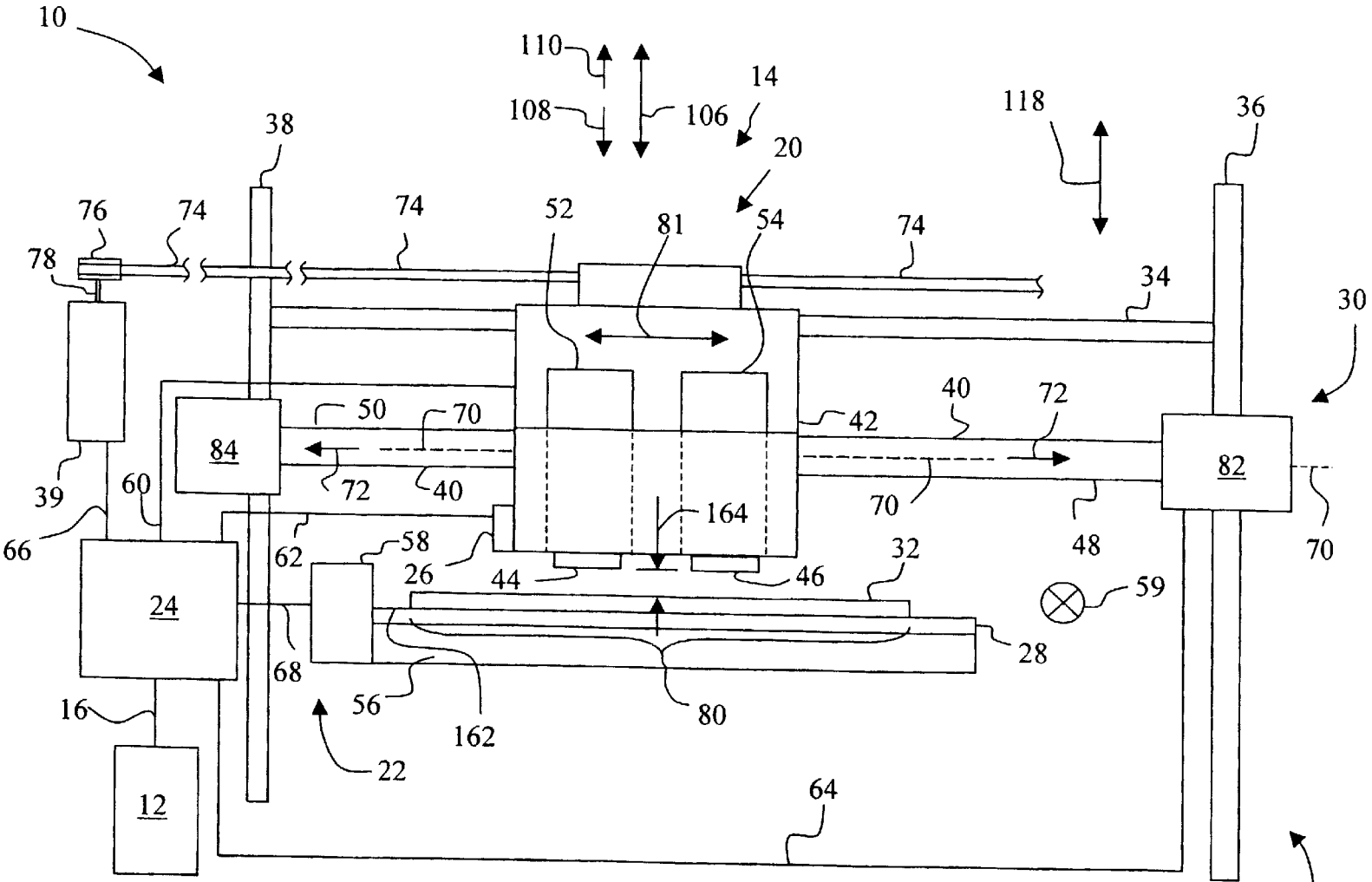
FIG. 1 is a diagrammatic representation of an imaging apparatus embodying the present invention, and including a printhead gap adjustment mechanism.

Referring now to the drawings and particularly to FIG. 1, there is shown an imaging apparatus 10 embodying the present invention. Imaging apparatus 10 includes a computer 12 and an imaging device in the form of an ink jet printer 14. Computer 12 is communicatively coupled to ink jet printer 14 via a communications link 16. Communications link 16 may be, for example, a direct electrical or optical connection, or a network connection.

Computer 12 is typical of that known in the art, and includes a display, input devices such as a mouse and/or a keyboard, a processor, and associated memory. Resident in the memory of computer 12 is printer driver software. The printer driver software places print data and print commands in a format that can be recognized by ink jet printer 14.

Ink jet printer 14 includes a frame 18, a printhead carrier system 20, a feed roller unit 22, a controller 24, a sensor 26, a mid-frame 28, and a printhead gap adjustment mechanism 30. Ink jet printer 14 is used for printing on a recording medium 32.

Frame 18 includes a guide rail 34, frame side 36, and frame side 38.

Printhead carrier system 20 includes a carrier motor 39, a carrier shaft 40, and a printhead carrier 42 that carries sensor 26, a color printhead 44, and a black printhead 46, for printing on recording medium 32. Carrier shaft 40 includes a proximal end 48 and distal end 50, and is rotably and slidably coupled to printhead carrier 42 and to frame 18. A color ink jet reservoir 52 is provided in fluid communication with color printhead 44, and a black ink reservoir 54 is provided in fluid communication with black printhead 46. Printhead carrier system 20, including color printhead 44 and black printhead 46, may be configured for unidirectional printing or bi-directional printing.

Feed roller unit 22 includes an index roller 56 and corresponding index pinch rollers (not shown). Index roller 56 is driven by a drive unit 58. The pinch rollers apply a biasing force to hold the sheet of recording medium 32 in contact with respective driven index roller 56. Drive unit 58 includes a drive source, such as, for example, a stepper motor and an associated drive mechanism, such as a gear train or belt/pulley arrangement. Feed roller unit 22 feeds recording medium 32 in a feed direction 59. As shown in FIG. 1, sheet feed direction 59 is depicted as an X within a circle to indicate that the sheet feed direction is in a direction perpendicular to the plane of FIG. 1, toward the reader.

Controller 24 is electrically connected to color printhead 44, and black printhead 46 via an interface cable 60. Controller 24 is electrically connected to sensor 26 via interface cable 62. Controller 24 is also electrically connected to printhead gap adjustment mechanism 30 via interface cable 64, to carrier motor 39 via interface cable 66, and to drive unit 58 via interface cable 68.

Controller 24 includes a microprocessor having an associated random access memory (RAM) and read only memory (ROM). Controller 24 executes program instructions to effect the printing of an image on the sheet of recording medium 32, such as coated paper, plain paper, photo paper and transparency. In addition, controller 24 executes instructions to conduct printhead adjustment based on information received from sensor 26.

Sensor 26 may be, for example, a unitary optical sensor including a light source, such as a light emitting diode (LED), and a reflectance detector, such as a phototransistor. The reflectance detector is located on the same side of a media as the light source. The operation of such sensors is well known in the art, and thus, will be discussed herein to the extent necessary to relate the operation of sensor 26 with regard to the present invention. For example, the LED of sensor 26 directs light at a predefined angle onto a reference surface, such as the surface of the sheet of recording medium 32, a mid-frame 28, or any other chosen reference surface, and an amount of light reflected from the surface is received by the reflectance detector of sensor 26. The intensity of the reflected light received by the reflectance detector varies with the height of the sensor relative to the reference surface, and reaches a local maximum, or peak, at some design focal distance of sensor 26 relative to the reference surface. Thus, when sensor 26 is closer to the reference surface than the design focal distance, the intensity of the detected reflected light would be less than the peak intensity obtained when sensor 26 is at the design focal distance. Similarly, when sensor 26 is farther from the reference surface than the design focal distance, the intensity of the reflected light detected by the reflectance detector will be less than the peak intensity obtained when sensor 26 is at the design focal distance.

The light received by the reflectance detector of sensor 26 is converted to an electrical signal by the reflectance detector, and transmitted by sensor 26 to controller 24 via interface cable 62. The signal generated by the reflectance detector corresponds to an intensity of the light received, and is indicative of the position of sensor 26, hence printhead carrier 42 and printheads 44, 46, relative to the reference surface.

Printhead carrier 42 is guided by carrier shaft 40 and guide rail 34. Printhead carrier 42 is slidably and rotably coupled to carrier shaft 40, and is slidably coupled to guide rail 34 in two mutually perpendicular directions. A carrier shaft centerline 70 of carrier shaft 40 defines a bi-directional scanning path 72 for printhead carrier 42. Printhead carrier 42 is connected to a carrier transport belt 74 that is driven by carrier motor 39 via carrier pulley 76 to transport printhead carrier 42 in a reciprocating manner along carrier shaft 40 and guide rail 34. Carrier motor 39 can be, for example, a direct current (DC) motor or a stepper motor. Carrier motor 39 has a rotating carrier motor shaft 78 that is attached to carrier pulley 76.

The reciprocation of printhead carrier 42 transports ink jet color printhead 44 and black printhead 46 across a sheet of recording medium 32, such as paper or film, along bi-directional scanning path 72 to define a print zone 80 of ink jet printer 14. This reciprocation occurs in a main scan direction 81 that is parallel with bi-directional scanning path 72, and is also commonly referred to as the horizontal direction.

Referring now to FIGS. 1, 2A, 3, 4, 5A and 5B, affixed to frame 18 is a printhead gap adjustment mechanism 30. Printhead gap adjustment mechanism 30 includes an active adjuster 82, a passive adjuster 84, and a drive mechanism 86. Drive mechanism 86 may include, for example, a drive motor 88.

Figures 2A, 2B:
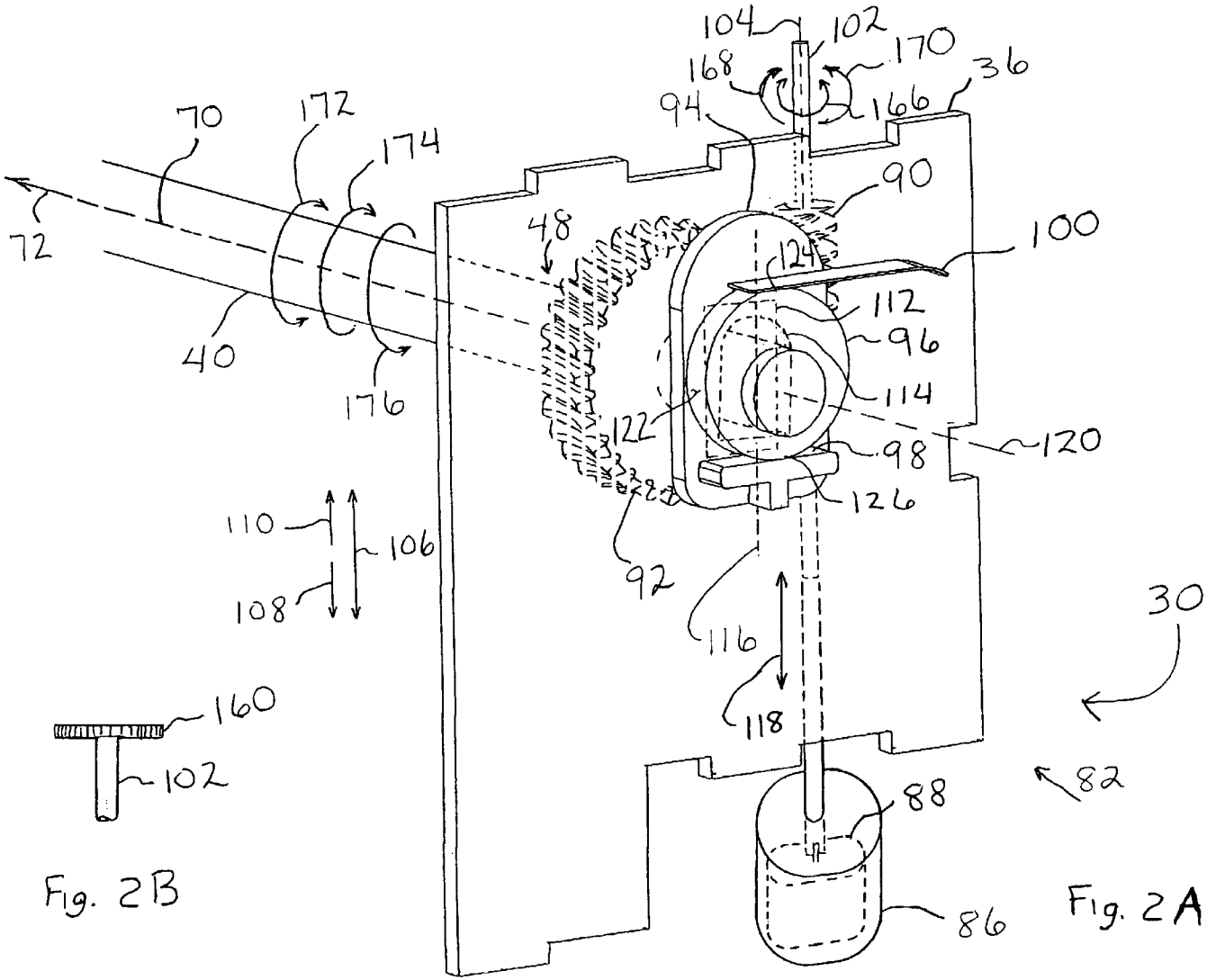
FIG. 2A is right side perspective view of the present invention, particularly, a view of an active adjuster of the printhead gap adjusting mechanism of FIG. 1.
FIG. 2B depicts a manual actuator for use in an alternative embodiment of the present invention.

Active adjuster 82 includes a worm screw 90; a worm gear 92; a guide device, such as a guide, depicted in FIG. 2A as a guide insert 94; a cam 96; a cam follower surface 98; and a biasing device, such as a spring mechanism, depicted in FIG. 2A as a cantilever beam spring 100. Active adjuster 82 is affixed to frame side 36.

Worm screw 90 includes a worm screw shaft 102. Worm screw 90 is rotably coupled with frame side 36 via bushing mounts (not shown) that receive worm screw shaft 102. Worm screw 90 includes an axis of rotation 104 that is substantially parallel with a bi-directional printhead gap adjustment direction 106. Printhead gap adjustment direction 106 may be defined, for example, as a direction substantially perpendicular to recording medium 32, and such that motion of printhead carrier 42 in a printhead gap adjustment direction 106 does not include components of motion in either of main scan direction 81 or feed direction 59, other than those resulting from manufacturing tolerances. Printhead gap adjustment direction 106 includes a printhead gap closing direction 108 and a printhead gap opening direction 110.

Worm screw 90 is positioned in rotational cooperation with worm gear 92. Worm gear 92 is coupled and affixed to proximal end 48 of carrier shaft 40 to transmit a rotational motion to carrier shaft 40. Worm screw 90 is capable of transmitting rotational motion to worm gear 92. Worm gear 92 is capable of transmitting rotational motion to carrier shaft 40. Proximal end 48 of carrier shaft 40 is rotably and slidably received into frame side 36 through a frame aperture 112. Guide insert 94 is affixed to frame side 36 of frame 18. Guide insert 94 includes a shaft guide slot 114 having a guide slot major axis 116 that is substantially parallel with printhead gap adjustment direction 106. In the embodiment shown, a bi-directional translational direction 118, shown in FIGS. 2A, 3, and 4, defined by major axis 116 of shaft guide slot 114, is substantially parallel to printhead gap adjustment direction 106. The terms translation and translational are used to generally refer to linear motion or direction. Proximal end 48 of carrier shaft 40 is rotably and slidably received into shaft guide slot 114 of guide insert 94. Guide insert 94 guides proximal end 48 of carrier shaft 40 in bi-directional translational direction 118 substantially parallel to axis of rotation 104 of worm screw 90, thus substantially parallel to printhead gap adjustment direction 106.

Cam 96 is coupled, such as by fixed attachment, about a cam center of rotation 120 of cam 96 to proximal end 48 of carrier shaft 40 such that a rotational motion of carrier shaft 40 is transmitted to cam 96. Cam center of rotation 120 is disposed coincidently with carrier shaft centerline 70. Cam 96 includes a cam riding surface 122, a cam high point 124 of cam riding surface 122, and a cam low point 126 of cam riding surface 122. The cam high point 124 is disposed farther from the cam center of rotation 120 than is the cam low point 126. Cam riding surface 122 transitions smoothly between cam high point 124 and cam low point 126. Disposed in proximity to cam riding surface 122 of cam 96 is cam follower surface 98. As shown in FIG. 2A, guide insert 94 includes and is integral with cam follower surface 98, for engaging with cam 96.

Cantilever beam spring 100 is affixed to frame side 36, and urges cam riding surface 122 of cam 96 against cam follower surface 98. However, as it is known in the art, other means may be used to render cam 96 in rotable and slidable contact with cam follower surface 98.

Figure 5B:
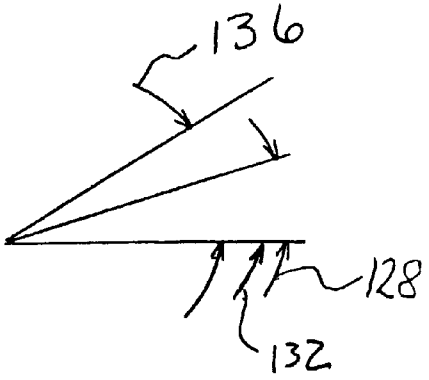
FIG. 5B is a graphical representation showing that worm screw lead angle and worm gear lead angle in relation to a friction angle.
Figure 5A:
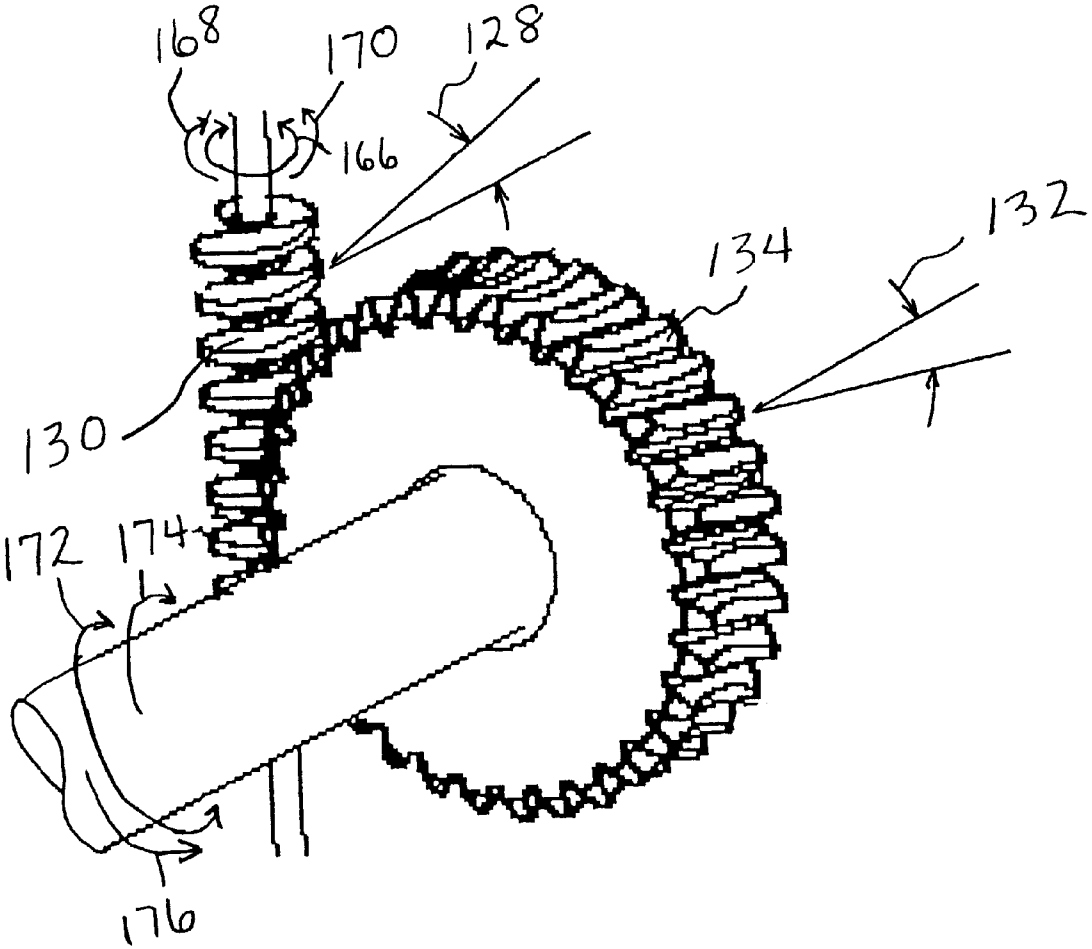
FIG. 5A depicts a worm screw of the printhead gap adjusting mechanism of FIG. 1 positioned in rotational cooperation with a worm gear and illustrates a worm screw lead angle and a worm gear lead angle.

Depicted in FIG. 5A, worm screw 90 includes a worm screw lead angle 128, and at least one worm screw tooth load bearing surface 130. Worm gear 92 includes a worm gear lead angle 132 that drivingly meshes with worm screw lead angle 128. Worm gear 92 also includes at least one worm gear tooth load bearing surface 134. Worm screw lead angle 128 is substantially the same in magnitude as worm gear lead angle 132. Worm screw lead angle 128 and worm gear lead angle 132 are less than a friction angle 136 between worm screw tooth load bearing surface 130 and worm gear tooth load bearing surface 134, as depicted in FIG. 5B, such that when worm screw 90 stops transmitting rotational motion to drive cam 96, worm screw 90 is not back-driven by worm gear 92.

Figure 3:
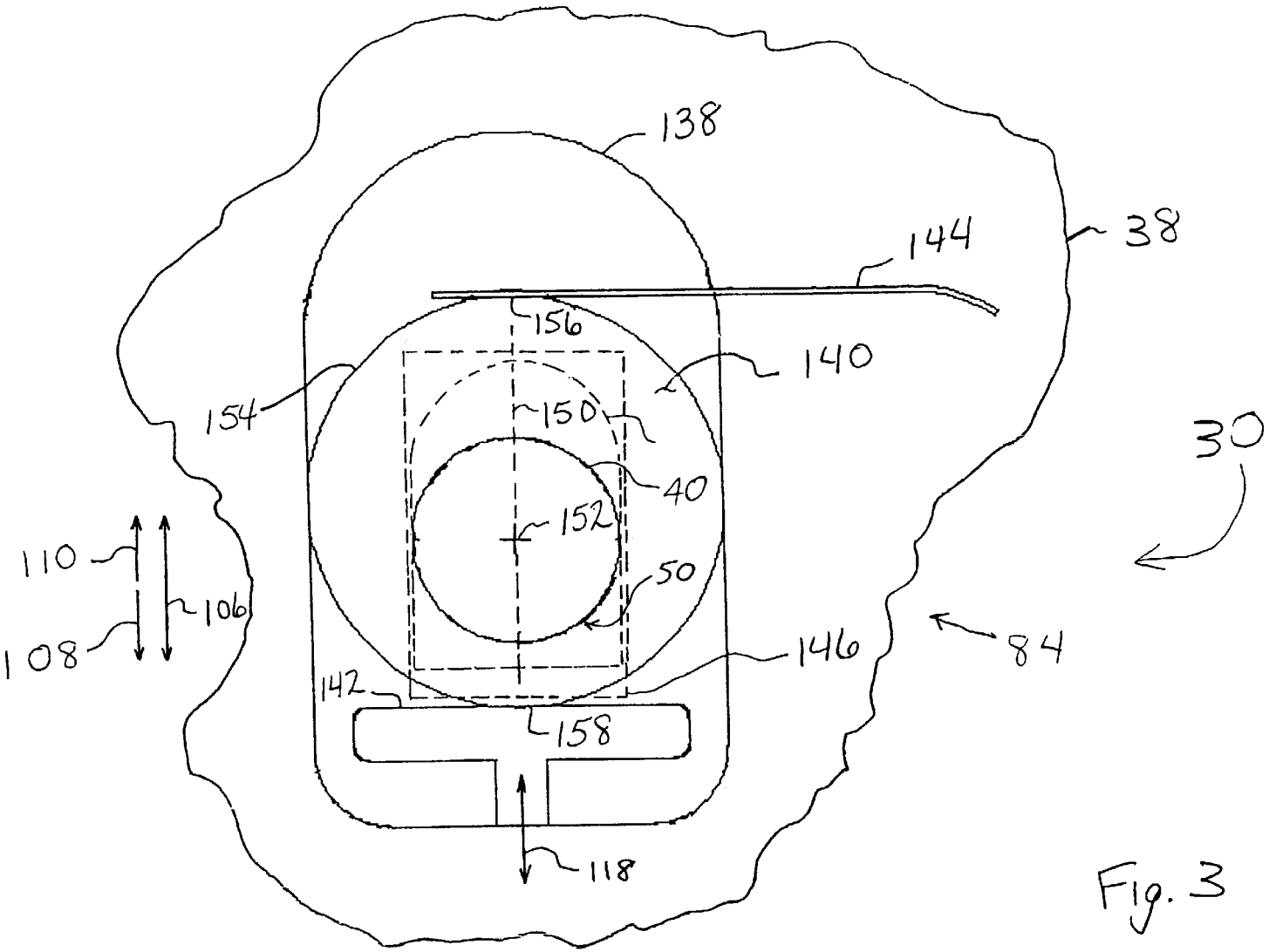
FIG. 3 is a left side view depicting a passive adjuster of the printhead gap adjusting mechanism of FIG. 1.
Figure 4:
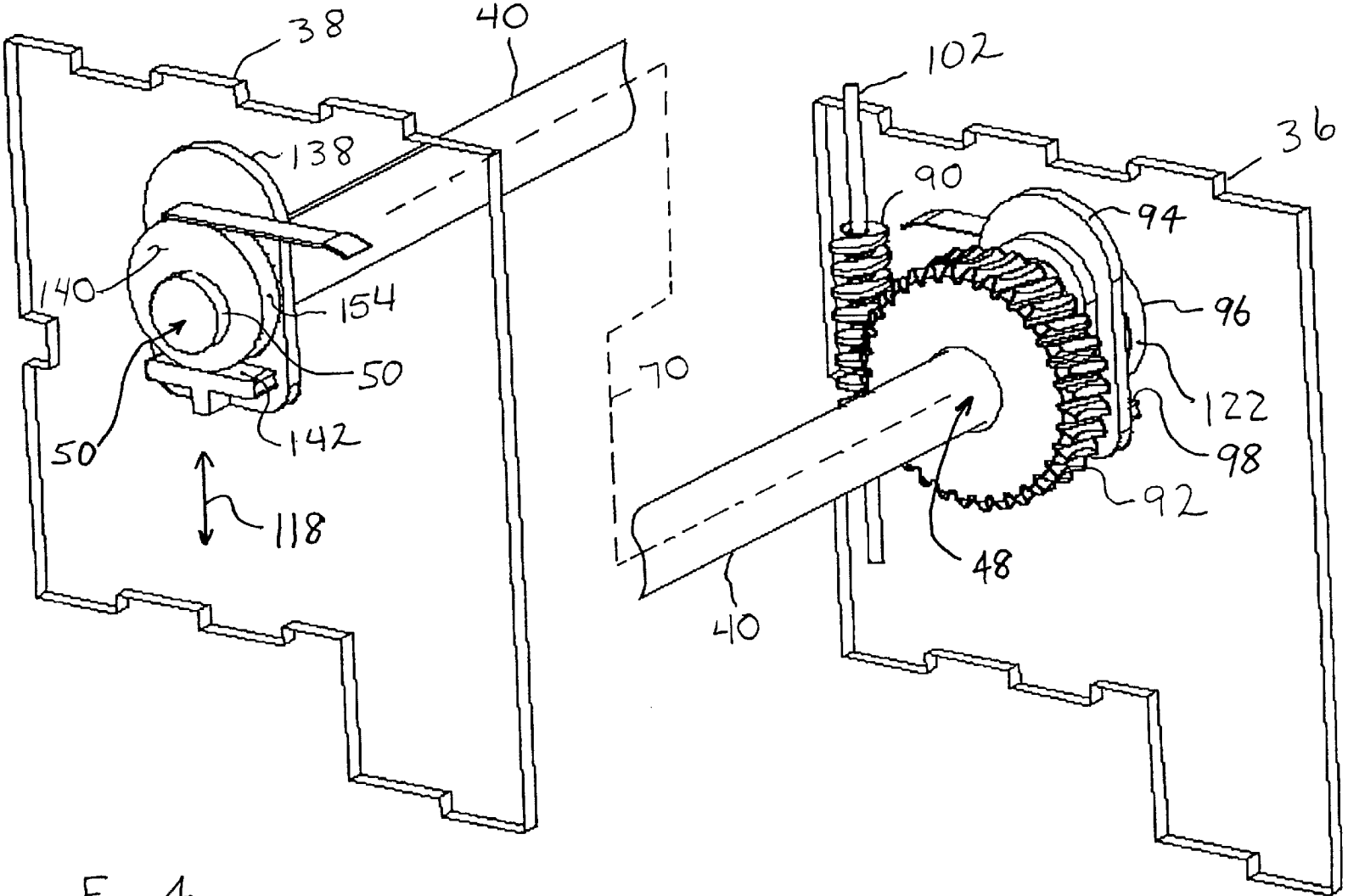
FIG. 4 is a left side perspective view of the printhead gap adjustment mechanism of FIG. 1.

Referring to FIGS. 1, 3, and 4, passive adjuster 84 includes a guide device, such as a guide, depicted in FIG. 3 as a guide insert 138; a cam 140; a cam follower surface 142; and a biasing device, such as a spring mechanism, depicted in FIG. 3 as a cantilever beam spring 144. Guide insert 138 is substantially identical to guide 94, shown in FIG. 2A.

Passive adjuster 84 is affixed to frame side 38. Distal end 50 of carrier shaft 40 is rotably and slidably received into frame side 38 through a frame aperture 146. Guide insert 138 is affixed to frame side 38 of frame 18. Guide insert 138 includes a shaft guide slot 148 having a guide slot major axis 150 that is substantially parallel with printhead gap adjustment direction 106 and translational direction 118. Distal end 50 of carrier shaft 40 is rotably and slidably received into shaft guide slot 148 of guide insert 138. Referring particularly to FIG. 3, guide insert 138 guides distal end 50 of carrier shaft 40 in bi-directional translational direction 118 that is substantially parallel to axis of rotation 104 of worm screw 90. In the embodiment shown, bi-directional translational direction 118 is substantially parallel to printhead gap adjustment direction 106, and guides distal end 50 of carrier shaft 40 in printhead gap adjustment direction 106.

Cam 140 that is coupled, such as by fixed attachment, about a cam center of rotation 152 of cam 140 to distal end 50 of carrier shaft 40, such that a rotational motion of carrier shaft 40 is transmitted to cam 140. Cam 140 is spaced apart from cam 96. Cam center of rotation 152 is disposed coincidently with carrier shaft centerline 70. Cam 140 includes a cam riding surface 154, at least one cam high point 156 of cam riding surface 154, and at least one cam low point 158 of cam riding surface 154. The cam high point 156 is disposed farther from the cam center of rotation 152 than is the cam low point 158. Cam riding surface 154 transitions smoothly between cam high point 156 and cam low point 158. Cam 140, including cam center of rotation 152, cam riding surface 154, cam high point 156, and cam low point 158 are disposed in rotational alignment with cam 96, including cam center of rotation 120, cam riding surface 122, cam high point 124, and cam low point 126, respectively. In addition, the physical dimensions and contours of cam 140 are the identical, within manufacturing tolerances, with the physical dimensions of cam 96, including those pertaining to cam centers of rotation 120 and 152, and cam riding surfaces 122 and 154, including cam high points 124 and 156, cam low points 126 and 158, and the smooth transitions there between.

Cam follower surface 142 is disposed in proximity to cam riding surface 154 of cam 140. Cam follower surface 142 is positioned such that wherein a rotational motion of carrier shaft 40 is transmitted to cam 140, cam 140 engaging cam follower surface 142 to effect translational motion of carrier shaft 40 in printhead gap adjustment direction 106. As depicted in FIGS. 3 and 4, guide insert 138 includes and is integral with cam follower surface 142, for engaging with cam 140. Cam follower surface 142 is disposed in proximity to cam riding surface 154 in the same magnitude and direction as cam follower surface 98 is disposed relative to cam riding surface 122, within manufacturing tolerances.

Cantilever beam spring 144 is affixed to frame side 38, and urges cam 140 against cam follower surface 142 to render cam riding surface 154 of cam 140 in rotating sliding contact with cam follower surface 142.

Referring to FIG. 2A, drive mechanism 86 of printhead gap adjustment mechanism 30 is affixed to frame 18. As shown in FIG. 2A, drive motor 88 of drive mechanism 86 is connected to worm screw 90. Drive motor 88 may be a simple DC motor, or may be a stepper motor, and is coupled to and operably controlled by controller 24. Controller 24 is electrically connected to drive motor 88 via interface cable 64, for providing control signals to drive motor 88 to transmit or effect a rotation of worm screw 90. Alternatively, drive unit 58 might be mechanically coupled to drive mechanism 86, eliminating the need for the separate drive motor 88. As a further alternative, worm screw 90 may be driven by a ratchet mechanism actuated by movement of printhead carrier 42. As a still further alternative, as shown in FIG. 2B, drive mechanism 86 might include a manual actuator 160, such as a dial, connected to worm screw 90, via worn screw shaft 102, in order to manually operate printhead gap adjustment mechanism 30.

Carrier shaft 40, worm screw 90, worm gear 92, cam 96, cam follower surface 98, guide insert 94, and drive mechanism 86 cooperate such that wherein rotation of worm screw 90 transmit s a rotational motion to drive cam 96 via worm gear 92 and carrier shaft 40, cam 96 engages cam follower surface 98 to effect a translational motion of worm gear 92 in a bi-directional translational direction 118, thereby effecting a movement of color printhead 44 and black printhead 46 in bi-directional translational direction 118.

Referring again to FIG. 1, during a printhead gap Adjustment operation, controller 24 cooperates with carrier motor 39 to position sensor 26, affixed to printhead carrier 42 over a printhead gap reference locator 162. The printhead gap reference locator 162 may be any surface that is parallel to and detectably viewable by sensor 26, including mid-frame 28, recording medium 32, or any other feature chosen to be printhead gap reference locator 162. In the embodiment illustrated in FIG. 1, the printhead gap reference locator 162 is depicted as a portion of mid-frame 28. Once printhead carrier 42 is positioned such that sensor 26 is detectably adjacent to printhead gap reference locator 162, carrier motor 39 is commanded by controller 24 to stop motion of printhead carrier 42 so that printhead gap adjustment operations can be commenced.

Referring to FIGS. 1, 2A, 3, and 4, in order to adjust a printhead gap, i.e., the gap between printheads 44, 46, and recording medium 22, controller 24 sends signals to printhead gap adjustment mechanism 30 via interface cable 64 to cause printhead carrier 42, and thus sensor 26 to translate in bi-directional printhead gap adjustment direction 106. Electrical signals corresponding to the detected intensity of reflected light are sent via interface cable 62 to controller 24. If the electrical signals received by controller 24 reduce in magnitude during the translation of sensor 26, controller 24 will reverse the direction of translation in the bi-directional printhead gap adjustment direction 106. From the detected reflectance intensity signals, controller 24 controls printhead gap adjustment mechanism 30 via interface cable 64 to cause sensor 26 to be spaced apart from printhead gap reference locator 162 at a distance corresponding to a design focal distance of local maximum of reflected intensity, which distance is related to a printhead gap distance 164. Offsets from the design focal distance can then be calculated by controller 24 to accommodate various thickness of recording medium 22, while maintaining a constant printhead gap.

The relationship between the design focal distance of the local maximum of reflected intensity and printhead gap distance 164 differs relative to the choice of printhead gap reference locator 162. In the embodiment illustrated by FIG. 1, wherein the printhead gap reference locator 162 is a portion of mid-frame 28, the printhead gap distance 164 is approximately equal to the design focal distance of local maximum of reflected intensity minus the thickness of the recording media. Determination of printhead gap distance 164 is made by controller 24. After printhead gap distance 164 is determined, controller 24 sends signals to printhead gap adjustment mechanism 30 via interface cable 64 to cause printhead carrier 42, and thus color printhead 44 and black printhead 46 to translate in bi-directional printhead gap adjustment direction 106 to achieve a printhead gap distance optimized for the desired operation of imaging apparatus 10. It is to be understood that the optimum printhead gap distance 164 may vary with the selection of recording medium 32, the desires of the end-user, e.g., print speed, print quality, etc.

The operation of printhead gap adjustment mechanism 30, and particularly active adjuster 82, is described as follows. In order to operate printhead gap adjustment mechanism 30, controller 24 provides control signals via interface cable 64 to drive motor 88. Drive motor 88 operates drive mechanism 86 to effect a rotation of worm screw 90 in one of the two bi-directional directions, as depicted by direction arrow 166, and includes worm screw clockwise rotation 168 and worm screw counterclockwise rotation 170. The rotation of worm screw 90 is transmitted to worm gear 92 causing a rotation and translation carrier shaft 40 in translational direction 118. As used herein, relational terms, such clockwise, counterclockwise, up and down are used for convenience and clarity in describing the invention shown, and are not intended to be limiting.

The rotation of carrier shaft 40 is in one of the two of bi-directional directions as depicted by direction arrow 172, and includes carrier shaft clockwise rotation 174 and carrier shaft counterclockwise rotation 176. In the embodiment shown, rotation of worm screw 90 in a first rotational direction, such as worm screw clockwise rotation 168, results in a carrier shaft counterclockwise rotation 176. Rotation of carrier shaft 40 is transmitted to cam 96 via the attachment of cam 96 to proximal end 48 of carrier shaft 40. Cam riding surface 122 of cam 96 is urged by cantilever beam spring 100 into in contact with cam follower surface 98. Rotation of carrier shaft 40 is transmitted to cam 140 via the attachment of cam 140 to distal end 50 of carrier shaft 40. Cam riding surface 122 is urged by cantilever beam spring 144 into contact with cam follower surface 142.

Figure 6:
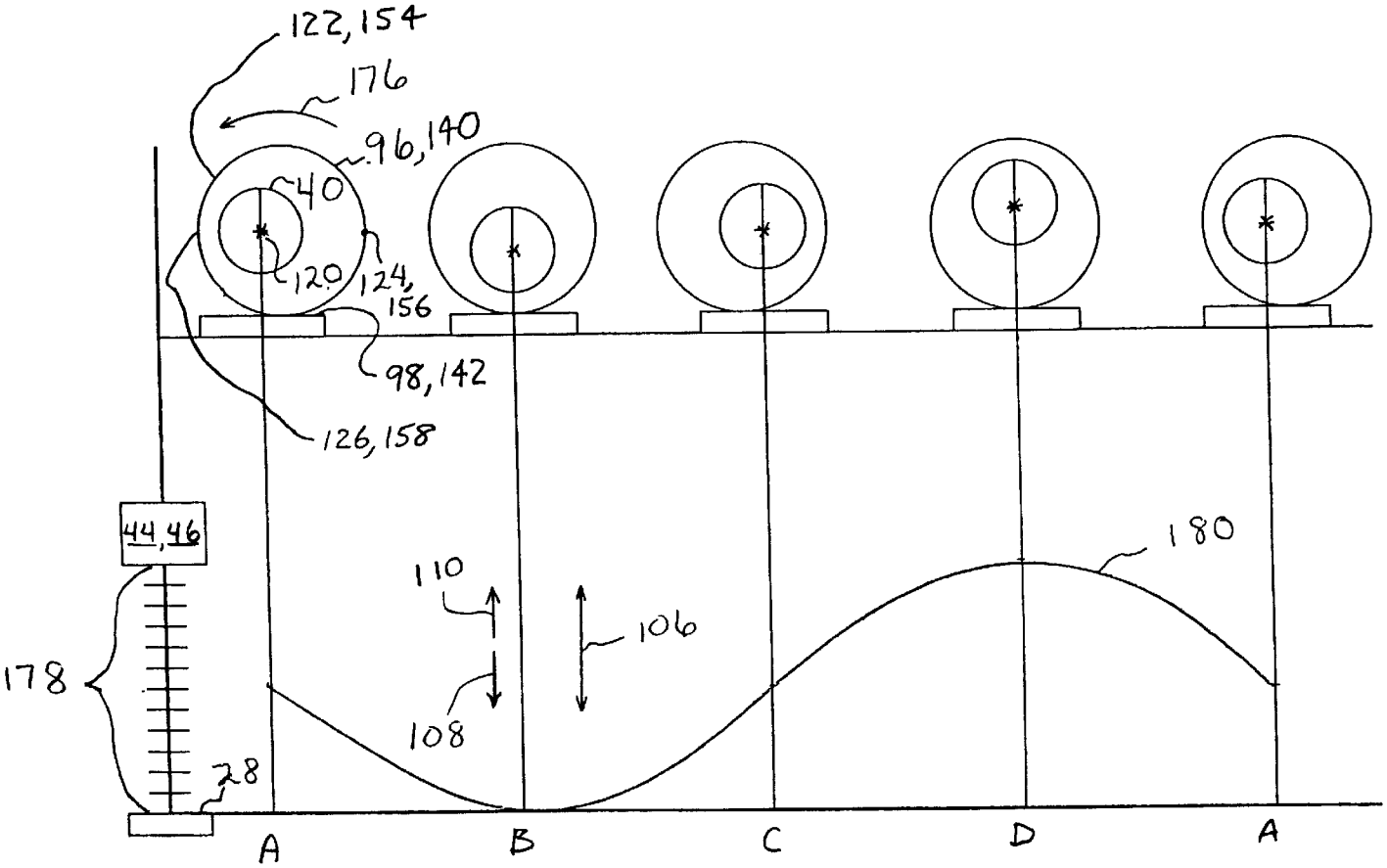
FIG. 6 is graphical representation depicting a printhead gap adjustment range with respect to different positions of a cam.

FIG. 6 shows a graphical representation depicting a printhead gap adjustment range 178 with respect to different positions of cams 96, 140. Printhead gap adjustment range 178 is the range of printhead gap adjustment to be achieved by printhead gap adjustment mechanism 30. As depicted in FIG. 6, printhead gap adjustment range 178 is magnified for purposes of clarity. Also, depicted in FIG. 6 is a printhead gap adjustment curve 180, which illustrates a printhead gap distance with respect to the position of cams 96, 140.

For purposes of illustrating the operation of the present invention, it is assumed that cams 96, 140 are in cam position A, as depicted in FIG. 6, as a starting point. It is further assumed, for purposes of illustration, that drive mechanism 86 imparts a worm screw clockwise rotation 168 to worm screw 90. As previously indicated, a worm screw clockwise rotation 168 results in a carrier shaft counterclockwise rotation 176, hence a like counterclockwise rotation of cams 96, 104.

The rotation of worm screw 90 in worm screw clockwise rotation 168, effects movement of carrier shaft 40 in a first translational direction, such as printhead gap closing direction 108 until cams 96, 140 reach cam position B (see FIG. 6), and a further rotation of worm screw 90 in the same worm screw clockwise rotation 168 direction effects movement of carrier shaft 40 in a second translational direction, such as printhead gap opening direction 110, as depicted between cam position B and D.

In another operational mode, the present invention includes wherein a first rotation of worm screw 90 in a first rotational direction, such as a worm screw clockwise rotation 168, effects movement of carrier shaft 40 in one of a first translational direction, such as printhead gap closing direction 108 (i.e., from cam position D to A to B in FIG. 6) and a second translational direction, such as printhead gap opening direction 110 (i.e., from cam position B to C to D in FIG. 6), and a second rotation of worm screw 90 in a second rotational direction, opposite to the first rotational direction, such as a worm screw counterclockwise rotation 170, effects movement of carrier shaft 40 in the other of the first translational direction and the second translational direction.

Thus, it is to be noted that the operation of passive adjuster 84 is similar to active adjuster 82. As seen in FIG. 6, beginning a position a counterclockwise rotation of cam 96, and corresponding rotation of cam 140, causes carrier shaft 40 to translate in printhead gap closing direction 108 under the guiding influence of shaft guide slots 114, 148, following printhead gap adjustment curve 180 from cam position A towards cam position B. Here, a rotation of worm screw 90 causes both rotation of carrier shaft 40 and translation of carrier shaft 40 in printhead gap closing direction 108. During the translational motion between cam positions A and B, worm gear 92 moves down worm screw 90, as worm gear 92, thus carrier shaft 40, is translated in printhead gap closing direction 108, while worm gear 92 is meshingly and slidably rotating with respect to worm screw 90. At cam position B, the printhead gap is at the low end of printhead gap adjustment range 178.

Continued counterclockwise rotation of cams 96 and 140 beyond cam position B, as depicted in FIG. 6, causes worm gear 92 to move up worm screw 90, and results in the translation of carrier shaft 40 in printhead gap opening direction 110 under the guiding influence of shaft guide slots 114 and 148, following printhead gap adjustment curve 180, until cam position D is reached. At cam position D, the printhead gap is at the high end of printhead gap adjustment range 178.

Continued counterclockwise rotation of cams 96 and 140 beyond cam position D, as depicted in FIG. 6, will result in the translation of carrier shaft 40 in printhead gap closing direction 108 under the guiding influence of shaft guide slots 114 and 148, following printhead gap adjustment curve 180, until cam position B is reached once again.

Hence, bi-directional translation of carrier shaft 40 and printhead carrier 42 in a printhead gap adjustment direction 106 is achieved by unidirectional rotation of worm screw 90. This advantageously allows the use of a low cost unidirectional motor to serve as drive motor 88 in order to make printhead gap adjustments. During such translational motion of printhead carrier 42, worm gear 92 may be seen "walking down" and "walking up" worm screw 90 as worm gear 92 is translated in printhead gap closing direction 108 and printhead gap opening direction 110, respectively, while meshingly and slidably rotating with respect to worm screw 90.

It is readily understood that reversing the direction of rotation of worm screw 90 will result in similar behavior of carrier shaft 40, cams 96 and 140, and worm gear 92. In other words, a continuous worm screw counterclockwise rotation 170 will result in printhead carrier shaft 40, translating in both printhead gap closing direction 108 and printhead gap opening direction 110, without changing the direction of rotation of worm screw 90.

It is further readily understood that by reversing the direction of rotation of worm screw 90 at any time, the translational motion and translational direction of carrier shaft would be reversed at that time.

It is still further readily understood that infinite adjustment in bi-directional printhead gap adjustment direction 106, within printhead gap adjustment range 178, may be made.

It is to be further understood that all of the aforementioned operations may be readily completed by hand, and without the use of a motor. For example, as previously indicated, a manual actuator 160, such as a dial, depicted in FIG. 2A, could be used to provide power to drive mechanism 86 in order to manually operate printhead gap adjustment mechanism 30.

In order to cease printhead gap adjustment operations, controller 24 provides control signals via interface cable 64 to stop drive motor 88. Drive motor 88 will then cease to power drive mechanism 86 to stop rotation of worm screw 90. Because both worm screw lead angle 128 and worm gear lead angle 132 are lower in magnitude than friction angle 136 at the location where the at least one worm screw tooth load bearing surface 130 mates with and drivingly meshes with the corresponding at least one worm gear tooth load bearing surface 134, advantageously, worm gear 92 will not back-drive worm screw 90 under the influence of acceleration or deceleration, including that of gravity or that imposed during operation or shipping.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead gap adjustment mechanism for use in an imaging apparatus, said imaging apparatus including a printhead carrier that carries a printhead, a frame, and a carrier shaft wherein said carrier shaft is rotably and slidably coupled with said printhead carrier and said frame, said printhead gap adjustment mechanism comprising:

a worm gear coupled to said carrier shaft to transmit a rotational motion to said carrier shaft;

a worm screw positioned in rotational cooperation with said worm gear, said worm screw having an axis of rotation;

a first cam coupled to said carrier shaft;

a first cam follower surface disposed in proximity to said first cam; and a guide device that guides said carrier shaft in a translational direction substantially parallel to said axis of rotation of said worm screw;

wherein a rotation of said worm screw transmits said rotational motion to drive said first cam via said worm gear and said carrier shaft, said first cam engaging said first cam follower surface to effect a translational motion of said worm gear in said translational direction, thereby effecting a movement of said printhead in said translational direction.

2. The printhead gap adjustment mechanism of claim 1, further comprising a first biasing device that urges said first cam against said first cam follower surface.

3. The printhead gap adjustment mechanism of claim 1, wherein:

said worm screw includes a worm screw lead angle and a worm screw tooth load bearing surface; and said worm gear includes a worm gear tooth load bearing surface and a worm gear lead angle that drivingly meshes with said worm screw lead angle;

wherein said worm screw lead angle is less than a friction angle between said worm screw tooth load bearing surface and said worm gear tooth load bearing surface, such that when said worm screw stops transmitting said rotational motion to drive said first cam, said worm screw is not back-driven.

4. The printhead gap adjustment mechanism of claim 1, wherein said translational direction is substantially parallel to a printhead gap adjustment direction.

5. The printhead gap adjustment mechanism of claim 4, further comprising:

a second cam coupled to said carrier shaft and spaced apart from said first cam; and a second cam follower surface disposed in proximity to said second cam;

wherein a rotation of said carrier shaft is transmitted to said first cam and said second cam to effect a translational motion of said carrier shaft in said printhead gap adjustment direction.

6. The printhead gap adjustment mechanism of claim 5, further comprising:

a first spring mechanism for biasing said first cam against said first cam follower surface; and a second spring mechanism for biasing said second cam against said second cam follower surface.

7. The printhead gap adjustment mechanism of claim 6, wherein each of said first spring mechanism and said second spring mechanism is a cantilever beam spring.

8. The printhead gap adjustment mechanism of claim 1, wherein said guide device comprises:

a first guide that guides a proximal end of said carrier shaft in a printhead gap adjustment direction; and a second guide that guides a distal end of said carrier shaft in said printhead gap adjustment direction.

9. The printhead gap adjustment mechanism of claim 8, wherein:

said first guide includes a first slot having a first major axis that is substantially parallel to said printhead gap adjustment direction; and said second guide includes a second slot having a second major axis that is substantially parallel to said printhead gap adjustment direction.

10. The printhead gap adjustment mechanism of claim 8, wherein:

said first guide includes a first guide insert affixed to said frame, said first guide insert includes said first cam follower surface; and said second guide includes a second guide insert affixed to said frame, said second guide insert includes a second cam follower surface.

11. The printhead gap adjustment mechanism of claim 1, wherein said translational direction is substantially parallel to a printhead gap adjustment direction, said printhead gap adjustment direction being bi-directional.

12. The printhead gap adjustment mechanism of claim 11, wherein a first rotation of said worm screw in a first rotational direction effects movement of said carrier shaft in a first translational direction, and a further rotation of said worm screw in said first rotational direction effects movement of said carrier shaft in a second translational direction.

13. The printhead gap adjustment mechanism of claim 11, wherein a first rotation of said worm screw in a first rotational direction effects movement of said carrier shaft in one of a first translational direction and a second translational direction, and a second rotation of said worm gear in a second rotational direction opposite to said first rotational direction effects movement of said carrier shaft in the other of said first translational direction and said second translational direction.

14. The printhead gap adjustment mechanism of claim 1, wherein said guide device includes at least one slot having a major axis that is substantially parallel to a printhead gap adjustment direction.

15. The printhead gap adjustment mechanism of claim 1, wherein said guide device is a guide insert that includes said first cam follower surface, said guide insert being affixed to said frame.

16. The printhead gap adjustment mechanism of claim 1, further comprising a second cam and a second cam follower disposed in proximity to said second cam, said first cam being connected to a proximal end of said-carrier shaft and said second cam being connected to a distal end of said carrier shaft.

17. An imaging apparatus including a printhead for printing on a recording medium, comprising:

a frame;

a carrier shaft rotably and slidably coupled to said frame;

a printhead carrier slidably coupled to said carrier shaft, wherein said printhead carrier carries said printhead;

a worm gear coupled to said carrier shaft to transmit a rotational motion to said carrier shaft;

a worm screw positioned in rotational cooperation with said worm gear, said worm screw having an axis of rotation;

a first cam coupled to said carrier shaft;

a first cam follower surface disposed in proximity to said first cam;

a guide device affixed to said frame, to guide said carrier shaft in a translational direction substantially parallel to said axis of rotation of said worm screw; and a drive mechanism connected to said worm screw to transmit a rotational motion to said worm screw;

wherein a rotation of said worm screw transmits said rotational motion to drive said first cam via said worm gear and said carrier shaft, said first cam engaging said first cam follower surface to effect a translational motion of said worm gear in said translational direction, thereby effecting a movement of said printhead in said translational direction.

18. The imaging apparatus of claim 17, wherein said translational direction is substantially parallel to a printhead gap adjustment direction.

19. The imaging apparatus of claim 17, further comprising a first biasing device that urges said first cam against said first cam follower surface.

20. The imaging apparatus of claim 17, wherein:

said worm screw includes a worm screw lead angle and a worm screw tooth load bearing surface; and said worm gear includes a worm gear tooth load bearing surface and a lead angle that drivingly meshes with said worm screw lead angle;

wherein said worm screw lead angle is less than a friction angle between said worm screw tooth load bearing surface and said worm gear tooth load bearing surface, such that when said worm screw stops transmitting said rotational motion to drive said first cam, said worm screw is not back-driven.

21. The imaging apparatus of claim 17, further comprising:

a second cam coupled to said carrier shaft and spaced apart from said first cam; and a second cam follower surface disposed in proximity to said second cam;

wherein said rotational motion of said carrier shaft is transmitted to said second cam, said second cam engaging said second cam follower surface to effect a translational motion of said carrier shaft in a printhead gap adjustment direction.

22. The imaging apparatus of claim 21, further comprising a first biasing device that urges said first cam against said first cam follower surface; and a second biasing device that urges said second cam against said second cam follower surface.

23. The imaging apparatus of claim 22, wherein:

said first biasing device is a first spring mechanism; and said second biasing device is a second spring mechanism.

24. The imaging apparatus of claim 23, wherein each of said first spring mechanism and said second spring mechanism is a cantilever beam spring.

25. The imaging apparatus of claim 17, wherein said guide device comprises:

a first guide that guides a proximal end of said carrier shaft in a printhead gap adjustment direction; and a second guide that guides a distal end of said carrier shaft in said printhead gap adjustment direction.

26. The imaging apparatus of claim 25, wherein:

said first guide includes a first slot having a first major axis that is substantially parallel to said printhead gap adjustment direction; and said second guide includes a second slot having a second major axis that is substantially parallel to said printhead gap adjustment direction.

27. The imaging apparatus of claim 25, wherein:

said first guide includes a first guide insert affixed to said frame, said first guide insert includes said first cam follower surface; and said second guide includes a second guide insert affixed to said frame, said second guide insert includes a second cam follower surface.

28. The imaging apparatus of claim 25, wherein said printhead gap adjustment direction is bi-directional.

29. The imaging apparatus of claim 17, wherein a first rotation of said worm screw in a first rotational direction effects movement of said carrier shaft in a first translational direction, and a further rotation of said worm screw in said first rotational direction effects movement of said carrier shaft in a second translational direction.

30. The imaging apparatus of claim 17, wherein a first rotation of said worm screw in a first rotational direction effects movement of said carrier shaft in one of a first translational direction and a second translational direction, and a second rotation of said worm gear in a second rotational direction opposite to said first rotational direction effects movement of said carrier shaft in the other of said first translational direction and said second translational direction.

31. The imaging apparatus of claim 17, wherein said guide device includes at least one slot having a major axis that is substantially parallel to a printhead gap adjustment direction.

32. The imaging apparatus of claim 17, wherein said guide device is a guide insert that includes said first cam follower surface, said guide insert being affixed to said frame.

33. The imaging apparatus of claim 17, said drive mechanism comprising a motor connected to said worm screw.

34. The imaging apparatus of claim 33, said drive mechanism further comprising a controller coupled to said motor for providing control signals to said motor to effect a rotation of said worm screw.

35. The imaging apparatus of claim 17, said drive mechanism comprising a manual actuator.

* * * * *